United States Patent [19]

Rochelle et al.

[11] 4,000,342

[45] Dec. 28, 1976

[54] PATTERNED WOVEN FABRIC

[75] Inventors: Morton Daniels Rochelle, Salisbury, N.C.; Frederick Eugene Lademan, Tenafly, N.J.

[73] Assignee: Fieldcrest Mills, Inc., Eden, N.C.

[22] Filed: Aug. 6, 1975

[21] Appl. No.: 602,283

[52] U.S. Cl. ..... 428/88; 26/29 R; 26/31; 26/37; 28/72 FT; 28/74 R; 28/75 WT; 428/89; 428/91; 428/96

[51] Int. Cl.[2] ..... B32B 33/00; D06C 11/00

[58] Field of Search ..... 428/88, 89, 91, 96, 428/260, 262; 28/1.2, 72 FT, 72.1, 72.11, 74 R, 74 WT, 72 CS, 72 WW; 8/2, 5, 20; 51/3, 31, 281 R; 26/29 R, 31, 37

[56] References Cited

UNITED STATES PATENTS

| | | | |
|---|---|---|---|
| 1,843,651 | 2/1932 | Slater | 428/91 |
| 3,931,427 | 1/1976 | Benzaquen | 428/91 |

*Primary Examiner*—Marion E. McCamish
*Attorney, Agent, or Firm*—Bell, Seltzer, Park & Gibson

[57] ABSTRACT

Tightly woven colored fabrics such as twills, denims, sateens, and poplins are provided with pattern areas thereon simulating the appearance of a printed design and wherein the pattern areas are of a color tone contrasting with the color of adjacent pattern areas and have a discernible softer texture imparting further contrast with the non-pattern areas. The contrasting tone colored pattern areas may either have a lighter color tone appearance than the non-pattern areas or a darker color tone appearance or the pattern areas may appear to change in color tone with respect to the background areas when the fabric is viewed at different angles. The contrasting tone colored pattern areas are defined by the exposed portions of the yarns forming the pattern areas having ruptured surface fibers extending from the surface of the fabric and presenting a fuzzy suede-like appearance to the pattern areas effecting a change in light reflection from the fabric and imparting a tactile relief effect to the pattern areas which provides further contrast between the pattern areas and the non-pattern areas.

11 Claims, 8 Drawing Figures

PATTERNED WOVEN FABRIC

This invention relates to textile fabrics, particularly woven fabrics, and it is an object of the invention to provide a woven fabric having pattern areas thereon which simulate the appearance of a printed design without employing pattern printing and are of a color tone contrasting with the color of adjacent non-pattern areas.

It is a further object of this invention to provide a woven fabric having pattern areas over the surface thereof which contrast both in appearance and in texture with non-pattern areas of the fabric to achieve an artistically and aesthetically appealing pattern effect over the surface of the fabric.

More particularly, it is an object of this invention to provide a woven colored fabric having contrasting tone pattern areas thereon which are produced much more economically than by conventional printing methods, and wherein the pattern areas also have a discernibly softer texture than adjacent non-pattern areas imparting further contrast with the non-pattern areas.

It is a still further object of the invention to provide a patterned woven fabric in a variety of different pattern appearances or effects with the contrasting tone pattern areas either having a lighter color tone appearance than the non-pattern areas or a darker color tone appearance, or wherein the pattern areas may appear to change in color tone with respect to the non-pattern background areas when the fabric is viewed at different angles. In accordance with one aspect of the invention, the pattern areas of the fabric may have a lighter color tone appearance than the adjacent non-pattern background areas and a surrounding halo of a color tone contrasting both with the pattern areas and the non-pattern areas is apparent along the border or edge of the pattern areas.

The selection of pattern designs in accordance with the invention is essentially unlimited and may, for example, take the form of stripes, plaids, checks, or isolated pattern areas or "islands"of any shape on a non-pattern background. The pattern design may also include intricate or complex designs such as one or more pattern areas against a background area and completely encircled by another pattern area.

The invention is applicable primarily to fabrics of tight woven construction such as twills, drills, denims, sateens and poplins, and preferably to tightly woven fabrics of high thread count and of a warp face construction. The fabric may be of an undyed natural color or may be colored by piece dyeing or by employing pre-colored warp and/or weft yarns therein. The yarns are preferably spun yarns of natural or synthetic fibers or of blends thereof.

The contrasting tone appearance of the colored pattern areas is achieved by controlled abrasion of the exposed surface portions of the yarns in selected areas of the fabric so as to rupture some of the fibers of the yarns and orient the ruptured surface fibers extending from the surface of the fabric above the level of the adjacent non-pattern areas to present a fuzzy suede-like surface appearance to the pattern areas effecting a change in light reflection therefrom. In the non-pattern areas, the surface fibers of the yarns are intact and non-ruptured. Preferably the ruptured surface fibers of the pattern areas extend obliquely from the surface of the fabric and are oriented in a common predominant direction generally warpwise of the fabric. The pattern areas exhibit a color tone contrasting with the color of the adjacent non-pattern areas with the ruptured fibers extending from the surface of the fabric imparting a tactile relief effect to the pattern areas which provides further contrast between the pattern areas and the adjacent non-pattern areas.

More particularly, the pattern effects are achieved in accordance with this invention by continuously passing the fabric across an adjustable back-up roll which positions the face of the fabric into a controlled amount of contact with a rotating abrasive coated cylinder or roll. The back-up roll is provided with a raised pattern design thereon in selected areas, which pattern is duplicated on the face of the fabric when the fabric is contacted by the abrasive coated roll. The controlled amount of contact with the abrasive coated roll is sufficient to rupture some of the fibers of the surface yarns while leaving the yarns themselves intact.

Applicants are aware of prior patents which disclose somewhat similar methods for producing patterns on fabrics. For example, Neave British Pat. No. 826, of 1880 and Turner U.S. Pat. No. 1,350,687, of 1920 disclose methods of obtaining ornamental patterns on soft felt fabrics such as felt hats by passing the fabrics across a patterned relief roll while subjecting the opposite side of the fabric to the action of a rotating abrasive covered roll to cut into or rub away portions of the surface of the fabric and form a pattern. The Neave patent further discloses a method for ornamenting woven fabrics by passing the fabric across a patterned relief roll while subjecting the opposite surface of the fabric to the napping action of a roll covered with cards, teasels or the like to form raised pile areas thereon.

In contrast to these prior practices, the present invention is applied to woven fabrics of a relatively hard or harsh feel and of the type not conventionally subjected to napping, and preferably to tightly woven fabrics of a warp face construction. The present invention neither carves the pattern into the fabric surface nor forms a nap by a napping operation, as in the methods noted in the aforementioned patents, but rather involves rupturing some of the fibers contained in the exposed warp yarns and causing the ruptured surface fibers in the pattern areas to extend obliquely from the surface of the fabric and being oriented in a common predominant direction. The ruptured fibers provide a suede-like appearance and a tactile relief effect to the pattern areas, but the height of the pattern areas as compared to the background areas is almost visually imperceptible and is not at all similar to either in height or in appearance to the type of long pile or nap achieved by conventional napping operations.

More particularly, the height of the pattern areas as compared to the level of non-pattern areas is generally smaller than the diameter of the yarns of the fabric, which is significantly less than a millimeter. Normally, the height of the pattern area is no more than about 0.2 millimeter (0.010inch) and desirably no more than about 0.1 millimeter (0.005 inch). By way of comparison, the nap or pile on conventionally napped fabrics is usually at least about 6 millimeters (¼ inch) or longer.

The present invention further achieves a variety of unique contrasting tone color effects not taught in the above noted prior patents, which color effects are accentuated by visual and tactile contrast in texture and weave pattern between the pattern and non-pattern areas.

Some of the objects and features of the invention having been described, other and further objects and features of the invention will become apparent from the following detailed description and from the accompanying drawings, in which FIG. 1 is a perspective view of a woven denim fabric having pattern areas thereon as achieved in accordance with a first embodiment of this invention, with the pattern areas being illustrated as stripes of a darker color tone than adjacent non-pattern areas;

Figure 1:
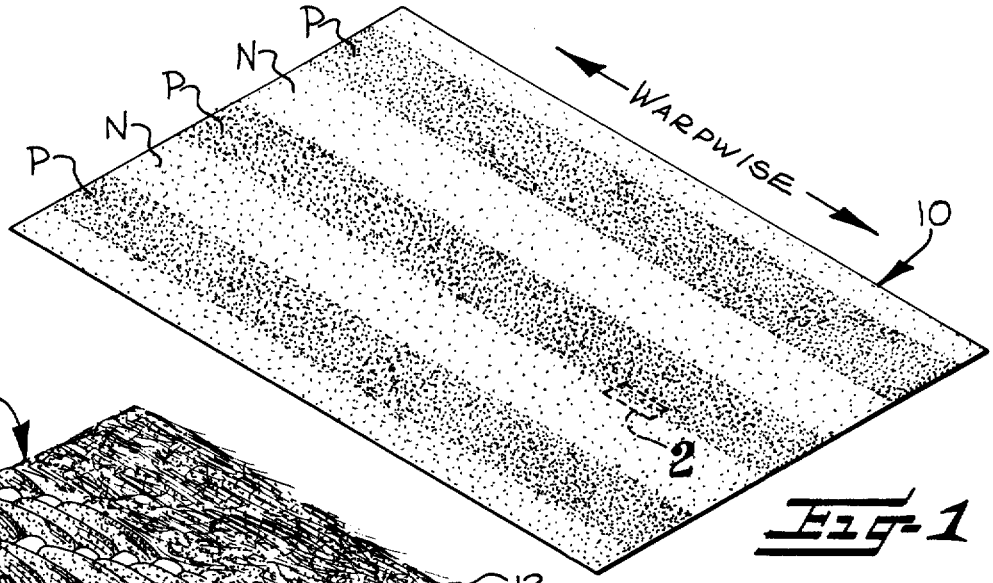

Referring more particularly to the drawings, FIG. 1 illustrates a fabric 10 in accordance with a first embodiment of the invention, with the fabric having pattern areas P thereon in the form of stripes extending longitudinally or warpwise of the fabric, and with non-pattern background areas N being located therebetween. It will be noted that the pattern areas P have a darker color tone appearance than the non-pattern areas N.

Figure 2:
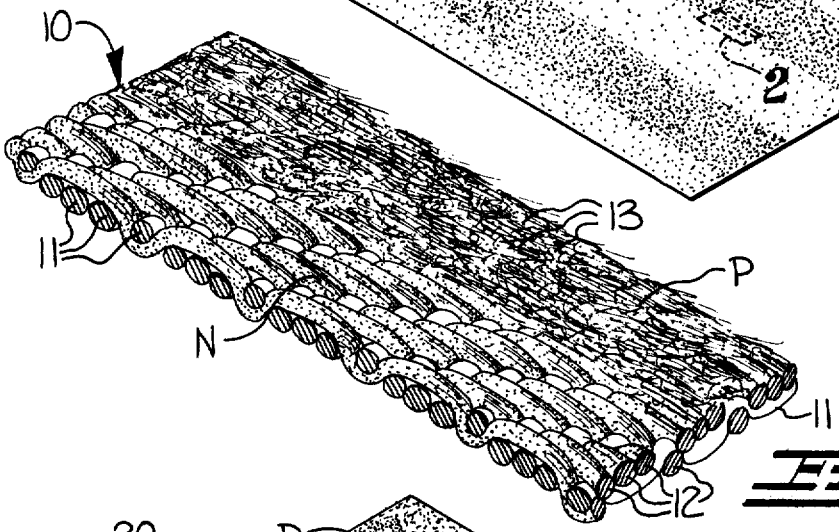
FIG. 2 is a greatly enlarged detailed perspective view of the fabric of FIG. 1 showing the portion of the fabric enclosed in broken lines.

The fabric, as shown in more detail in FIG. 2, is a twill weave denim fabric of tightly woven construction and high thread count. As is conventional in denim fabrics, the weft or filling yarns 11 are of a white or other light color, while the warp yarns 12 are pre-dyed a darker color, such as a deep indigo blue color. The warp yarns 12, more particularly, are of substantially uniform color throughout the cross section of the yarn, as achieved for example by vat dyeing. As is also conventional in denim fabrics, the warp yarns 12 are spun singles yarns of relatively high twist.

From FIG. 2, it will be apparent that the fabric 10 is of a warp face construction with the darker color warp yarns 12 being predominant on the surface of the fabric and with only relatively small portions of the lighter color weft yarns being visible therebelow. Thus, the color or appearance of the fabric in the non-pattern areas N is a visual mixture of a relatively large proportion of the darker color warp yarns and a relatively small proportion of the lighter color weft yarns.

In the pattern areas P of the fabric, the exposed surface portions of the warp yarns 12 have been abraded to rupture some of the surface fibers 13 of the darker color warp yarns 12 and cause these darker color ruptured fibers 13 to extend from the surface of the fabric. The density of the ruptured surface fibers of the darker color warp yarns presents a fuzzy suede-like appearance to the pattern areas P substantially masking from view the lighter color weft yarns therebelow so that the pattern areas thereby exhibit a darker color tone appearance than the adjacent non-pattern areas N. Further, the ruptured surface fibers 13 extending from the surface of the fabric tend to obscure the prominent twill lines apparent in the non-pattern areas of the fabric and also to impart a tactile relief effect to the pattern areas which further contrasts the pattern areas with the adjacent non-pattern areas.

The ruptured surface fibers 13 of the darker color warp yarns forming the pattern areas P extend obliquely from the surface of the fabric in a common predominant direction generally warpwise of the fabric and the pattern areas exhibit a fuzzy velvet or suede-like appearance which changes in color tone when the fabric is viewed at an angle in different directions.

Figure 3:
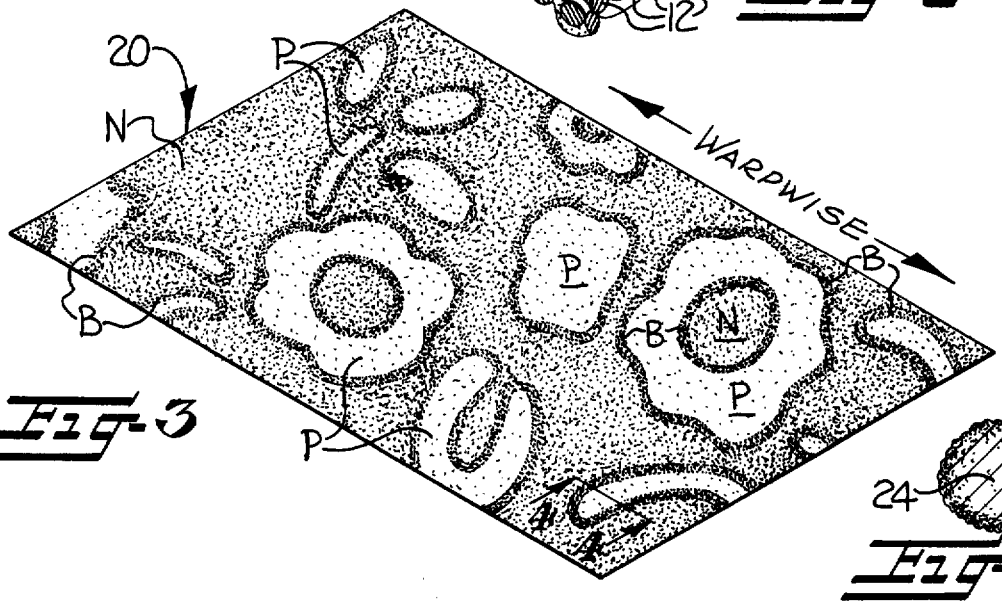
FIG. 3 is a perspective view of a woven denim fabric having pattern areas thereon in accordance with a second embodiment of the invention and wherein the pattern areas are of a lighter color tone than the non-pattern areas and are bordered by a "halo" of a color contrasting both with the pattern areas and the non-pattern areas.

FIG. 3 illustrates a patterned denim fabric 20 in accordance with a second embodiment of the invention. As illustrated, the pattern areas P are of a lighter color than the non-pattern background areas N, and a narrow border B of a color tone contrasting with both the pattern areas and the non-pattern areas is seen at the juncture between the pattern areas P and the non-pattern areas N.

Figure 5:
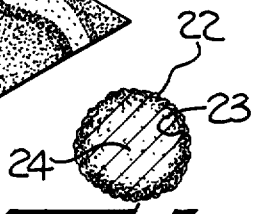
FIG. 5 is an enlarged cross-sectional view of one of the warp yarns of the fabric, taken along the line 5—5 of FIG. 4, and showing the yarn being colored or dyed at its surface and substantially undyed in the interior core portions of the yarn.
Figure 4:
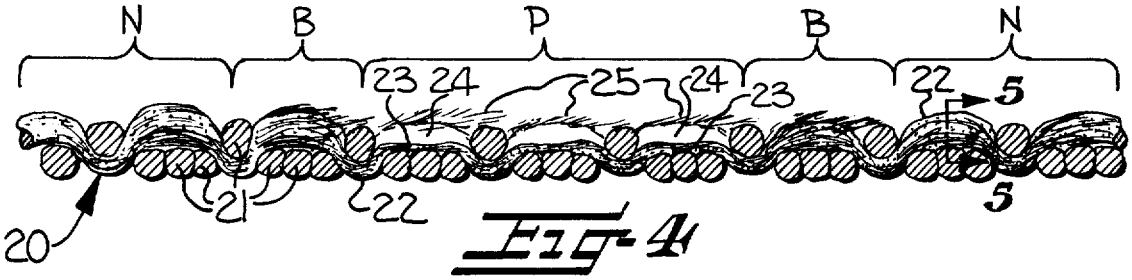
FIG. 4 is a greatly enlarged sectional view of the fabric taken substantially along the line 4—4 of FIG. 3.

Referring more particularly to the construction of the fabric, as best seen in cross section in FIG. 4, it will be noted that the fabric is a conventional twill weave denim fabric similar to that illustrated in FIGS. 1 and 2 having undyed white or other light colored weft yarns 21 and darker color pre-dyed warp yarns 22. The basic difference of the denim fabric of this embodiment over that of the previously described embodiment of FIGS. 1 and 2 is that the warp yarns 22, instead of being of a uniform color throughout the cross sections are dyed or colored substantially only at their exterior surfaces 23, with the interior or core portions 24 of the yarns being substantially undyed. This is illustrated in FIG. 5. This type of dyeing may be achieved, for example, by padding the yarns in a conventional manner with a relatively thick paste of the dye.

Referring more particularly to FIG. 4, it will be seen that the lighter color tone effect in the pattern areas P results from some of the exposed surface fibers 25 of the darker color warp yarns 22 in the pattern areas being ruptured and exposing uncolored interior fibers of the warp yarns. In the warp face twill weave denim fabric construction illustrated, the portions of the warp yarns 22 forming the twill lines are the highest points on the surface of the fabric and are subjected to the abrading without involving the lower positioned weft yarns 21. The color of these portions of the weft yarns is noticeably lighter in the pattern areas than in the non-pattern areas. It is believed that some of the lighter color appearance of the yarns results from some of the dye or color at the surface of the yarns being removed during the abrasive patterning operation.

For example, a denim fabric having the conventional color of deep indigo blue warp yarns exhibits a deep indigo color along the twill lines in the non-pattern areas, but exhibits a mottled light blue color throughout the pattern areas. Because of the density of the upstanding ruptured fibers 25, the twill lines in the pattern areas P are considerably less well defined than in the non-pattern areas N, thereby further contrasting the appearance of the pattern areas with the non-pattern areas. The density of the upstanding ruptured fibers 25 in the pattern areas presents a fuzzy suede-like appearance to the pattern areas and also substantially masks from view the lighter color weft yarns therebelow.

The narrow border areas B, which appear as contrasting color "halos" surrounding or encircling the pattern areas P, comprise areas at the juncture of the pattern areas P and the non-pattern areas N where the color of the exposed warp yarns has been removed to a lesser degree than in the pattern areas. Ruptured surface fibers 25 are still present in these areas but in a lower density than in the pattern areas P, although still sufficient to obscure the lighter color weft yarns 21 and render less distinct the prominent twill lines apparent in the non-pattern areas N. The overall visual impression is that of a "halo" outlining the pattern areas and being of an intermediate color tone contrasting both with that of the pattern areas P and the non-pattern areas N.

The present invention is also applicable to tightly woven fabrics other than denims. For example, the fabric may be of a sateen, poplin or plain weave or of a tightly woven twill weave construction similar to that illustrated in FIGS. 2 and 4, but with the warp and weft yarns being of the same color throughout the fabric. However, as noted with respect to the previous embodiment, it is preferred, regardless of the weave pattern, that the fabric be of a warp face construction. Even though the same color yarns are used both in the warp and the weft, a different color tone appearance is visible in the pattern areas than in the non-pattern areas. Further, the ruptured fibers of the warp yarns in the pattern areas present a fuzzy suede-like appearance to the pattern areas obscuring the weave pattern therein and imparting a tactile relief effect to the pattern areas further contrasting the pattern areas with the adjacent non-pattern areas.

The fabric may be piece dyed prior to imparting the patterned appearance thereto so that the ruptured surface fibers of the yarns are dyed to the same depth of color as the intact fibers of the yarns. Under such circumstances, the colored pattern areas exhibit a subtle lighter color tone than surrounding non-pattern areas resulting from a change in light reflection from the pattern areas as compared to the non-pattern areas.

In accordance with another aspect of the invention, the fabric may be piece dyed after treatment of the fabric to impart the patterned surface appearance thereto. In this event, the pattern areas exhibit a subtle darker color tone than the adjacent non-pattern areas resulting from the ruptured surface fibers being free and extending from the surface of the fabric during piece dyeing and thereby being more exposed to the dye than the intact fibers of the yarns so as to achieve a greater depth of color.

In both of the just described embodiments of the invention where similar color warp and weft yarns are present in the fabric, the difference in color between the pattern areas and the non-pattern areas is much more subtle than in denim fabrics where different colored yarns are involved, and may be characterized as "tone-on-tone" effect. Further, the appearance and color tone of the pattern areas as compared to the non-pattern areas may vary depending upon the angle of view of the fabric. As noted earlier with respect to the denim fabric of FIG. 1, the pattern areas have ruptured surface fibers which extend obliquely from the surface of the fabric and are oriented in a common predominant direction generally warpwise of the fabric. Because of the difference in reflection of incident light from the obliquely oriented fibers, the pattern areas of the fabric exhibit a darker tone appearance when viewed warpwise in one direction along the fabric than when viewed warpwise in the opposite direction.

Figure 6:
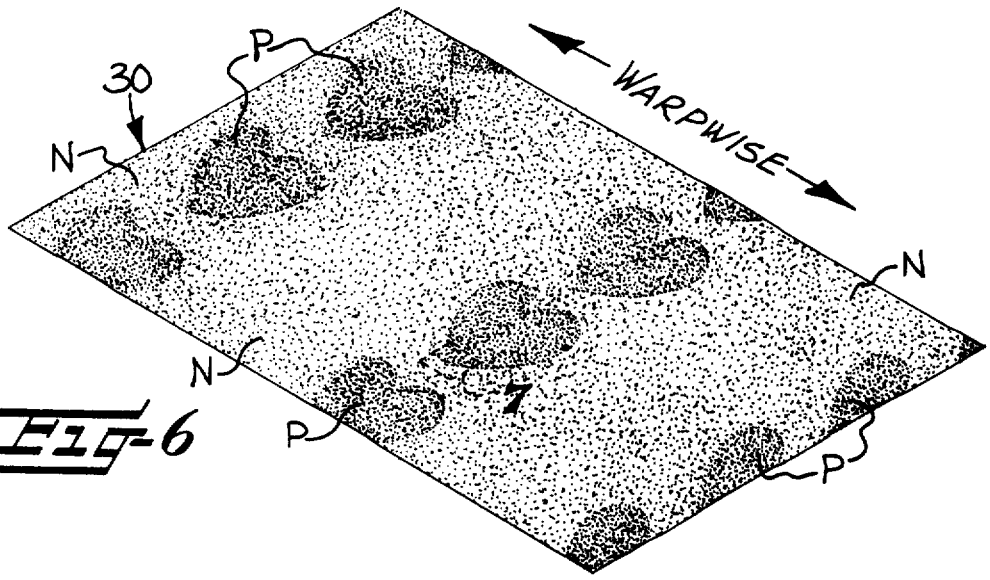
FIG. 6 is a perspective view showing a pattern effect achieved upon a piece-dyed warp face plain weave fabric in accordance with a further embodiment of the invention and wherein the pattern areas appear darker than the surrounding non-pattern background areas.

This phenomenon may be understood more easily by referring to FIG. 6. As illustrated, pattern areas P in the form of hearts are visible on the surface of the fabric 30, with the heart shaped pattern areas being of a subtle darker tone than adjacent non-pattern areas N. However, when the fabric 30 is turned 180° and viewed warpwise along the opposite direction, as illustrated in FIG. 8, the heart shaped pattern areas P appear as lighter areas against a contrasting darker tone background area N.

Figure 7:
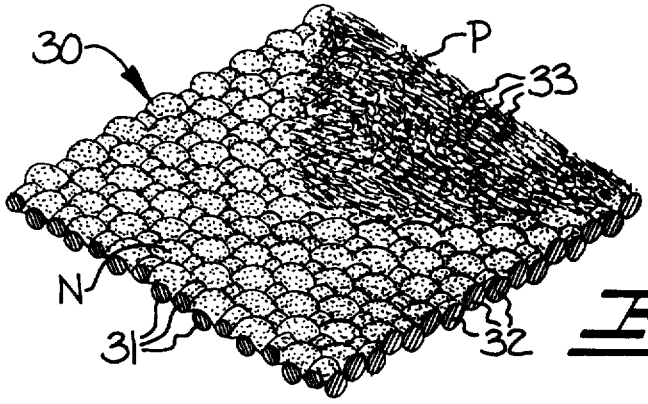
FIG. 7 is a greatly enlarged perspective view of the portion of the fabric shown in broken lines in FIG. 6.
Figure 8:
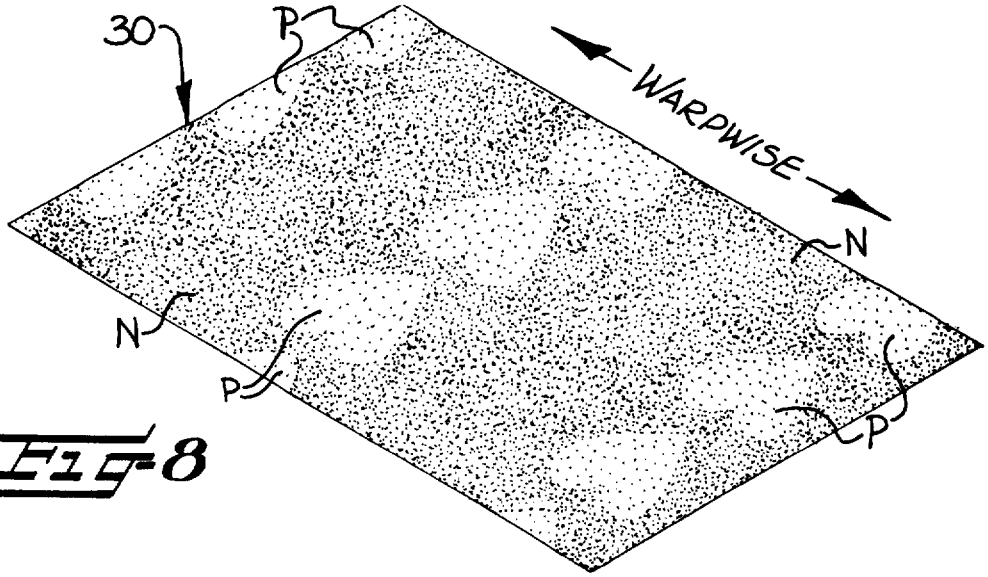
FIG. 8 is a perspective view of the same fabric illustrated in FIG. 6 but turned 180°, and wherein the pattern areas appear lighter than the surrounding non-pattern background areas.

FIG. 7 illustrates in more detail the weave construction of the fabric 30 illustrated in FIGS. 6 and 8. It will be apparent that the fabric is of a tightly woven plain weave construction of high thread count, with both the warp yarns 32 and the weft yarns 31 being of the same color, and with the warp yarns 12 being slightly larger than the weft yarns 11. Further, the fabric is woven as a warp face fabric to present the warp yarns 32 more prominently on the surface of the fabric and with the weft yarns 31 being nestled between and below the level of the adjacent warp yarns.

Although not readily apparent from FIG. 7, the ruptured fibers 33 in the pattern area P consists essentially of ruptured fibers of the warp yarns 32, since such warp yarns are prominently exposed at the surface of the fabric for being subjected to the patterning treatment. The density of the ruptured fibers in the pattern area P is sufficiently large so as to present a fuzzy suede-like appearance to the pattern area which substantially obscures the weave pattern therein and thereby further contrasts the pattern area with the adjacent non-pattern areas.

In the drawings and specification, there have been set forth preferred embodiments of the invention, and although specified terms are employed, they are used in a generic and descriptive sense only and not for purposes of limitation.

That which is claimed is:

1. A tightly woven colored fabric such as twills, denims, sateens, and poplins having pattern areas thereon simulating the appearance of a printed design without employing pattern printing and characterized in that the pattern areas are of a color tone contrasting with the color of the adjacent non-pattern areas and have a discernible softer texture imparting further contrast with the adjacent non-pattern areas, said fabric comprising tightly interwoven warp and weft yarns of predetermined color throughout the fabric, the exposed portions of the yarns in said non-pattern areas comprising intact non-ruptured surface fibers, said contrasting tone colored pattern areas comprising exposed portions of the yarns forming the pattern areas having ruptured surface fibers extending from the surface of the fabric presenting a fuzzy suede-like surface appearance to the pattern areas and effecting a change in light reflection therefrom, the pattern areas thereby exhibiting a color tone contrasting with the color of the adjacent non-pattern areas, and said ruptured fibers in said pattern areas extending from the surface of the fabric above the level of the adjacent non-pattern areas and imparting a tactile relief effect to said pattern areas further contrasting the pattern areas with the adjacent non-pattern areas.

2. A fabric according to claim 1 wherein the ruptured surface fibers presenting a fuzzy suede-like surface appearance to said colored pattern areas extend obliquely from the surface of the fabric and are oriented in a common predominant direction generally warpwise of the fabric and the pattern areas of the fabric exhibit a darker color appearance when viewed warpwise in one direction along the fabric than when viewed warpwise in the opposite direction.

3. A fabric according to claim 1 wherein said tightly interwoven warp and weft yarns are interwoven to form a warp-face fabric with the warp yarns predominantly defining the face of the fabric, and wherein said ruptured surface fibers presenting a fuzzy suede-like surface appearance to the pattern areas are predominantly ruptured fibers of said warp yarns.

4. A fabric according to claim 1, wherein said weft yarns are of a relatively light color and said warp yarns are of a predetermined relatively darker color, said warp and weft yarns being interwoven to form a warp-face fabric with the darker color warp yarns predominantly defining the face of the fabric and with portions of the lighter color weft yarns being discernible therebelow, and wherein said ruptured surface fibers are predominantly ruptured fibers of said darker color warp yarns and the density of said ruptured fibers presents said fuzzy suede-like surface appearance to the pattern areas substantially masking from view the lighter color weft yarns therebelow.

5. A fabric according to claim 1 wherein said warp and weft yarns are of the same color throughout the fabric, said warp and weft yarns being interwoven in a predetermined visually discernible weave pattern and to form a warp-face fabric with the warp yarns predominantly defining the face of the fabric, and wherein said ruptured surface fibers are predominantly ruptured fibers of said warp yarns and the density of said ruptured fibers presents said fuzzy suede-like surface appearance to the pattern areas obscuring the weave pattern therein and thereby further contrasting the pattern areas with the adjacent non-pattern areas.

6. A fabric according to claim 5 wherein said fabric is piece-dyed to obtain said same color in the warp and weft yarns thereof and said ruptured surface fibers are of the same depth of color as the intact fibers of the yarns, and said colored pattern areas exhibit a subtle lighter color tone than surrounding non-pattern areas resulting from a change of light reflection therefrom.

7. A fabric according to claim 5 wherein said fabric is piece-dyed to obtain said same color in the warp and weft yarns thereof and wherein said pattern areas exhibit a darker color tone than the adjacent non-pattern areas resulting from said ruptured surface fibers extending from the surface of the fabric being more exposed to the dye than the intact fibers of the yarns and therefore being of a greater depth of color.

8. A tightly woven colored fabric such as denims having pattern areas thereon simulating the appearance of a printed design and characterized in that the pattern areas are of a color tone contrasting with the color of the adjacent non-pattern areas and have a discernible softer texture imparting further contrast with the adjacent non-pattern areas, said fabric comprising interwoven relatively dark color warp yarns and relatively light color weft yarns, said warp and weft yarns being spun yarns and being tightly interwoven to form a warp-face fabric with the darker color warp yarns being of high twist and predominantly defining the face of the fabric and with portions of said lighter color weft yarns being discernible therebelow, said contrasting tone colored pattern areas comprising exposed portions of the darker color warp yarns forming the pattern areas having ruptured surface fibers extending obliquely from the surface of the fabric, the density of said ruptured surface fibers of said darker color warp yarns presenting a fuzzy suede-like appearance to the pattern areas substantially masking from view the lighter color weft yarns therebelow and imparting a tactile relief effect to said pattern areas further contrasting the pattern areas with the adjacent non-pattern areas, and said obliquely extending ruptured surface fibers being oriented in a common predominant direction generally warpwise of the fabric with the pattern areas of the fabric exhibiting a darker tone appearance when viewed warpwise in one direction along the fabric than when viewed warpwise in the opposite direction.

9. A fabric according to claim 8 wherein all the fibers of said darker color warp yarns are of a substantially uniform color so that the ruptured surface fibers of said warp yarns in said pattern areas and the intact fibers of the warp yarns are of the same color, and said pattern areas defined by said ruptured surface fibers of said darker color warp yarns exhibit a darker color appearance than the adjacent non-pattern areas where the lighter color weft yarns are unmasked and therefore discernible.

10. A fabric according to claim 8 wherein interior portions of said darker color warp yarns are substantially undyed, and wherein said ruptured surface fibers of said warp yarns expose underlying undyed interior portions of the warp yarns and the pattern areas thereby exhibit a lighter color appearance contrasting with the color of the adjacent non-pattern areas.

11. A tightly woven colored fabric such as twills and sateens having pattern areas thereon simulating the appearance of a printed design and characterized in that the pattern areas are of a color tone contrasting with the color of the adjacent non-pattern areas and have a discernible softer texture imparting further contrast with the adjacent non-pattern areas, said fabric comprising interwoven warp and weft yarns of the same predetermined color throughout the fabric, said warp and weft yarns being spun yarns and being tightly interwoven in a predetermined weave pattern and to form a warp-face fabric with the warp yarns being of high twist and predominantly defining the face of the fabric, said contrasting tone colored pattern areas comprising exposed portions of the warp yarns forming the pattern areas having ruptured surface fibers extending obliquely from the surface of the fabric, the density of said ruptured surface fibers presenting a fuzzy suede-like appearance to the pattern areas obscuring the weave pattern therein and imparting a tactile relief effect to said pattern areas further contrasting the pattern areas with the adjacent non-pattern areas, and said obliquely extending ruptured surface fibers being oriented in a common predominant direction generally warpwise of the fabric with the pattern areas of the fabric exhibiting a darker tone appearance when viewed warpwise in one direction along the fabric than when viewed warpwise in the opposite direction.

* * * * *